United States Patent [19]

Shibukawa et al.

[11] Patent Number: 5,049,429

[45] Date of Patent: Sep. 17, 1991

[54] FUR-LIKE PILE FABRIC HAVING CONICAL SHAPED PILES COMPRISING GUARD HAIR-LIKE FIBERS AND DOWN HAIR-LIKE FIBERS

[75] Inventors: Yoshinori Shibukawa, Himeji; Yuzuru Yajima, Kakogawa, both of Japan

[73] Assignee: Kanegafuchi Chemical Industry Co., Ltd., Osaka, Japan

[21] Appl. No.: 401,184

[22] Filed: Aug. 31, 1989

[30] Foreign Application Priority Data

Aug. 31, 1988 [JP] Japan ..... 63-216962

[51] Int. Cl.[5] ..... B32B 3/02; D03D 27/00; D04H 11/00; D05C 17/00

[52] U.S. Cl. ..... 428/88; 428/85; 428/89; 428/92; 428/93; 428/96; 428/97; 156/296

[58] Field of Search ..... 428/92, 96, 97, 85, 428/89, 93, 88

[56] References Cited

U.S. PATENT DOCUMENTS

| | | | |
|---|---|---|---|
| 736,412 | 8/1903 | Lewin | 428/92 |
| 3,037,262 | 6/1962 | Spencer . | |
| 3,171,484 | 3/1965 | Thal . | |
| 3,236,587 | 2/1966 | Genereux . | |
| 3,755,057 | 8/1973 | Scott | 428/89 |
| 3,973,065 | 8/1976 | Walsh et al. | 428/89 |
| 4,340,631 | 7/1982 | Endo et al. . | |
| 4,459,128 | 7/1984 | Matsui et al. . | |
| 4,544,594 | 10/1985 | Li et al. | 428/92 |
| 4,576,840 | 3/1986 | Murata et al. | 428/97 |
| 4,613,529 | 9/1986 | Yamashita et al. | 428/92 |
| 4,781,951 | 11/1988 | Kitamura et al. | 428/92 |

FOREIGN PATENT DOCUMENTS

| | | |
|---|---|---|
| 0045611 | 2/1982 | European Pat. Off. . |
| 0218201 | 4/1987 | European Pat. Off. . |
| 1319521 | 1/1963 | France . |
| 1371428 | 7/1964 | France . |

*Primary Examiner*—George F. Lesmes
*Assistant Examiner*—James D. Withers
*Attorney, Agent, or Firm*—Wegner, Cantor, Mueller & Player

[57] ABSTRACT

A fur-like pile fabric which comprises guard hair-like fibers and down hair-like fibers wherein a plurality of the fibers including the guard hair-like fibers constitute a unit and at least the guard hair-like fibers in the unit are adhered together in a brush form, which has an appearance and feeling similar to natural furs.

7 Claims, 2 Drawing Sheets

FUR-LIKE PILE FABRIC HAVING CONICAL SHAPED PILES COMPRISING GUARD HAIR-LIKE FIBERS AND DOWN HAIR-LIKE FIBERS

BACKGROUND OF THE INVENTION

1. Field of the Invention

The present invention relates to a synthetic pile fabric having fur-like appearance.

2. Description of the Related Art

A natural fur comprises so-called guard hairs which are longer hairs and so-called down hairs which are shorter hairs and exist in cluster under the guard hairs. The guard hairs mainly protect animal bodies, while the down hairs insulate the body. The appearance and feeling of the fur depend on properties of the guard hairs. Although each hair of the fur looks thick, it is flexible and smooth since it has such a shape that its center portion is thick and it is tapered towards its tip.

As substitutes for the natural furs, artificial furs are made from synthetic fibers, particularly from pile fabrics since the pile fabric has a similar structure to that of the natural fur. Pile parts of the pile fabric are composed of guard hair-like fibers optionally together with down hair-like fibers. To produce the synthetic furs close to the natural furs, various attempts have been made. It was proposed to provide a synthetic fiber having a thicker center portion and a tapered tip portion. For example, Japanese Patent Kokai Publication No. 16910/1982 discloses a process for producing such synthetic fiber with a pulsation spinning technique, and Japanese Patent Kokai Publication No. 148961/1981 discloses a process for producing such synthetic fiber comprising partly dissolving the fiber end with a solvent.

However, when the artificial fur is fabricated with using the synthetic fibers produced by such conventional processes as the guard hair-like fibers, the fabricated furs may not have properties similar to the natural furs or may be expensive.

SUMMARY OF THE PRESENT INVENTION

One object of the present invention is to provide a novel artificial fur having properties similar to the natural furs.

Another object of the present invention is to provide a process for fabrication of an artificial fur having properties similar to the natural furs.

According to the present invention, there is provided a fur-like pile fabric which comprises guard hair-like fibers and down hair-like fibers wherein a plurality of the fibers including the guard hair-like fibers constitute a unit and at least the guard hair-like fibers in the unit are adhered together in a brush form.

DETAILED DESCRIPTION OF THE DRAWINGS

Figure 2:
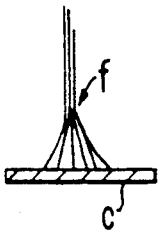
FIGS. 2, 4, 6 and 8 shows the shapes of the adhered fibers corresponding to FIGS. 1, 3, 5 and 7, respectively.
Figure 4:
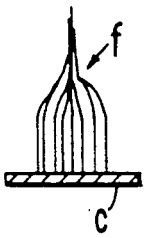
Figure 6:
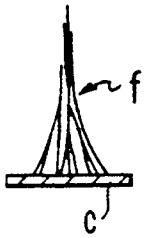

In the fur-like pile fabric of the present invention, a plurality of the fibers including the guard hair-like fibers are adhered in one unit like a brush (f) as shown in FIGS. 2, 4 and 6.

The shape of the adhered fibers in the unit may be of polygonal pyramid, cone or other shapes or combinations thereof.

The number of the fibers in one unit and the number of units in a unit area of the pile fabric of the present invention are not critical, and are adequately selected so that the fabricated pile fabric has properties as close as to the desired fur. In general, the number of the fibers in one unit is from several to several thousand fibers (e.g. four or five to six or seven thousands), preferably 10 to 5,000 fibers. The number of the units is at least 10 units, preferably at least about 50 units, more preferably at least 100 units per square inch (inch$^2$).

The depth of fiber to be adhered from the fiber tip is also selected according to the resiliency and feeling of the tips of adhered fibers. Only the guard hair-like fibers can be adhered, while the guard hair-like fibers can be adhered together with a part or whole of the down like fibers. Further, the adhesive may reach the base fabric of the pile fabric. Preferably, the guard hair-like fibers and the upper portions of the down hair-like fibers are adhered together while leaving the lower portions of the down hair-like fibers unadhered, since the pile fabric has better appearance and feeling.

Preferably, the guard hair-like fiber has a fineness of 5 to 50 deniers and is straight with less crimp. When the fiber is a modified cross section fiber such as a flat fiber or a foam fiber, the unit is flexible although it looks thick. Preferably, the guard hair-like fiber has a length of about 5 to 50 mm.

The down hair-like fiber has a length shorter than the guard hair-like fiber and preferably of about 2 to 40 mm. The fineness of the down hair-like fiber is usually smaller than that of the guard hair-like fiber, and preferably from 0.5 to 7 deniers. The down hair-like fibers may be crimped by a conventional method such as heat shrinking. When the fiber is crimped, the length of the fiber is measured in the crimped state.

In some cases, fibers having a fineness of 5 to 15 deniers and a length shorter than the guard hair-like fiber and longer than the down hair-like fiber may be used as middle hairs. The middle hairs may act as the guard hair-like fibers or as the down hair-like fibers.

Each kind of the guard hair-like fiber and the down hair-like fiber may have substantially the same length. Alternatively, the length of each kind of the fibers may have a distribution such as a stepwise distribution or continuous distribution. In this case, the length of the fiber is expressed in terms of an average value. The difference of length between the guard hair-like fibers and the down hair-like fibers is preferably at least 3 mm, particularly 4 to 10 mm.

Figure 1:
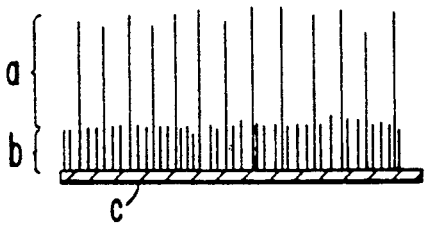
FIGS. 1, 3, 5 and 7 show raised pile fabrics before adhering the fibers.
Figure 3:
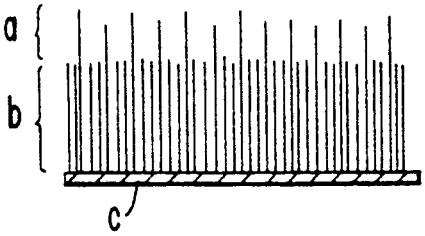
Figure 5:
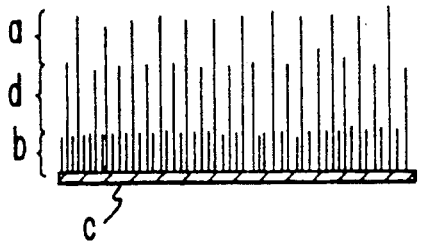
Figure 7:
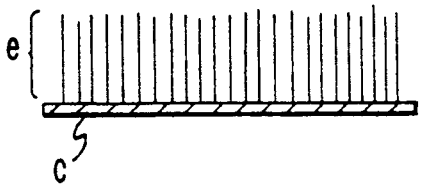

FIGS. 1, 3 and 5 show raised pile fabrics before adhering in which the guard hair-like fibers, the down hair-like fibers and the middle hairs are clearly distinguished from one another. FIG. 7 shows a raised pile fabric before adhering which consists of the guard hair-like fibers or the down hair-like fibers. The pile fabrics of FIGS. 1, 3 and 5 are raw fabrics of the fur-like pile fabrics of the present invention. In Figures, "a", "b", "c", "d" and "e" stand for a guard hair layer, a down hair layer, a pile base fabric, a middle hair layer and a raised hair pile layer consisting of the guard hair-like fibers or the down hair-like fibers, respectively.

Figure 8:
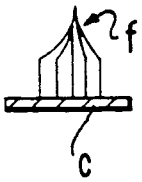

A purpose of use cf the guard hair-like fibers and the down hair-like fibers is to form sharp brush-like tips and to impart the covering property and resiliency to the fur-like pile fabric. If only the guard hair-like fibers or the down hair-like fibers are used as shown in FIG. 7, the tip of the adhered fibers becomes thick as shown in FIG. 8 so that the fabric loses flexibility of the fiber tip or good appearance.

An amount of the guard hair-like fibers is generally from 10 to 70% by weight, preferably from 10 to 50% by weight, and that of the down hair-like fibers is generally from 30 to 90% by weight, preferably from 50 to 90% by weight, both based on the weight of the whole pile fibers.

The fibers to be used in the present invention may be any of the conventional synthetic fibers. Examples of the fibers are those made of thermoplastic polymers such as vinyl polymers or copolymers comprising acrylonitrile, vinyl chloride or vinylidene chloride and those made of polyesters, polyamides, polyolefins, polyurethanes and the like. Among them, fibers made of polymers comprising at least 20% by weight of acrylonitrile are preferred. The fibers may be used independently or in combination. A part of the synthetic fibers may be replaced with natural fibers.

To fabricate the pile fabric having the properties similar to mink, fox, sable, wolf, chinchilla, bear, rabbit, etc, the properties of the fibers such as fineness, length, cross section, degree of crimp, heat shrinkage degree and hue are adequately selected. In addition, the ratio of the guard hair-like fibers to the down hair-like fibers, pile density and pile height are also adequately selected.

The fur-like pile fabric of the present invention may be fabricated by producing the pile fabric comprising the guard hair-like fibers and the down hair-like fibers and then adhering at least the guard hair-like fibers in the unit consisting of plural fibers including the hair-like fibers.

The pile fabric can be produced by a per se conventional method, for example, by using a sliver knitting machine, a pile (boa) knitting machine, a raschel knitting machine, a double weaving machine or a tufting machine, and then processing the raw fabric with brushing, polishing or shearing to obtain the raised pile fabric. Alternatively, a heat shrinkable fiber having a heat shrinking degree of 10 to 49% is used as the down hair-like fiber, and a non-shrinkable fiber is used as the guard hair-like fiber and the fibers are heat treated in the course of fabrication of the pile fabric whereby the shrinkable down hair-like fiber is shrunk so that its length is made shorter than the guard hair-like fiber. This method is often employed. There is no limitation on the finishing of the fabrication of the pile fabric. It is preferred not to let the fibers fall down excessively in view of homogeneous application of an adhesive.

A process for adhering the fibers is explained.

As the adhesive, any organic adhesive having required adhesive performances can be used. For example, the adhesive satisfies requirements such that the adhered materials are not easily separated, the adhered materials are not modified, and the adhesive is easily handled without causing any problem in work environments. Preferred examples of the adhesive are synthetic polymer base adhesives such as those comprising thermoplastic resins, thermosetting resins or elastomers, which are widely used for processing the fibers. Among them, the thermoplastic resin base adhesives comprising polyvinyl acetate, polyvinyl chloride, polyvinyl alcohol, polyvinyl acetal, polyacrylate, polyamide or polyolefin are more preferred since they are generally used to improve the feeling. Acrylate resin emulsions comprising a polymer of an acrylate or methacrylate are particularly preferred since they are easily handled and form a flexible and transparent film.

The kind of the adhesive may be selected according to desired flexibility, adhesive force and the like. A soft type adhesive is most preferred in view of the feeling of the pile fabric such as ductility of the adhered fiber tips and handling during sewing.

The amount of adhesive to be used cannot be uniformly determined, since the length of the fibers to be adhered or the amount of adhesive varies with the desired properties of the fur-like pile fabric of the present invention. For example, when the acrylate resin emulsion is used as the adhesive, the effects of the present invention are achieved from the dry resin amount of 0.1% by weight based on the weight of the pile fabric. As the amount of adhesive increases, the resiliency of the adhered fiber tips and adhesive force increase, and feeling becomes harder. This may apply to the thermosetting resin base adhesive and the elastomer base adhesive.

Typically, the adhering procedure comprises following three steps:

(1) application of the adhesive on the surface of prefinished pile fabric, (2) formation of units of the plural fibers with the removal of excessive adhesive from the pile fabric to form a brush shape, (3) setting the brush shaped unit fibers.

In the step (1), the adhesive may be applied onto the surface of the pile fabric with a spray gun, a kiss-roll coater or a spreading brush or by dipping. The adhesive may be applied on the fabric surface with its raised hairs down (pile down method) or with its raised hairs up (pile up method). To make the lie of hair uniform, the hairs are slanted at a certain angle by pressing an edge against the reverse face of the fabric during traveling of the pile fabric, or the hairs are brushed or beaten just before or during application of the adhesive. Such treatments of the hairs are preferred to form a thin tip of the adhered fibers. The depth of the adhesion, the amount of adhesive or easiness of the subsequent step (2) depend on the application mode of the adhesive, the concentration and applied amount of the adhesive solution in the step (1). Therefore, these factors should be carefully selected. In the application methods of the adhesive except the dipping, the adhesive tends to be applied only at the tip portions of the fibers, when the amount of adhesive is small. Thereby, the depth of adhesion can be adjusted.

In the next step (2), the excessive adhesive is removed and the brush shape of the fibers is formed. In general, the removal of the excessive adhesive and the formation of the brush shape are done substantially simultaneously. The step (2) may be carried out by beating from the reverse face of the pile fabric, brushing the surface of the pile fabric or centrifugal dehydration. Thereby, the adhesive applied on the surfaces of fibers or present in spaces among the fibers shifts to the fiber tips, so that the excessive adhesive is removed while the adhesive is uniformly distributed among the fibers. Further, the surface tension of the adhesive promotes the aggregation of the fibers so that the brush shape of the fibers is formed. In the step (2), the direction of force to be applied should be towards the fiber tips. When the force direction is towards the base fabric, the fabric becomes a mat.

It is preferred that, after the formation of the brush shape and before setting the shape, the pile portions are not in direct contact with bars or rolls.

In the shape-setting step (3), the adhesive is hardened or cured. In case of the aqueous acrylate resin emulsion, water is evaporated to form a film and then the film is cured.

The shape-setting may be carried out with an apparatus which is conventionally used for binder coating of back sizing agents and tentering, such as a dry hot air type or IR type tentering machine. The conditions for shapesetting vary with the amount of the adhesive. Usually, the shape is set at a temperature of 100 to 150° C. for 2 to 10 minutes. When the dry hot air type tentering machine is used, an air velocity is preferably adjusted so that the fibers are not folded or the lie of hair is not disturbed.

The steps (1) to (3) can be carried out continuously, semicontinuously or batch wise. To produce the furlike pile fabric with better appearance, the steps (2) and (3) are continuously done.

Before the application of adhesive, the fabric may be dyed, for example, by textile printing.

The fur-like pile fabric of the present invention may be used in making toys, clothes, interior goods, bedding materials and the like.

In the fur-like pile fabric of the present invention, a plurality of the fibers are adhered as one unit. Since the tip portion of the fiber unit consists of the guard hair-like fibers only, it is very sharp, while the root portion of the fiber unit comprises the guard hair-like fibers and the down hair-like fibers so that said portion looks very thick. If the tip portion of the fibers is adhered together as one unit, such effect can be achieved irrespective of whether or not the root portion is adhered together. Because of such structure, the pile fabric of the present invention has the appearance and feeling similar to those of the natural furs even when the pile fabric is fabricated from usual fibers but not from special fibers having tapered tip portions. Since the fiber unit has a thicker root portion than the guard hair prepared from the fibers having the tapered tip portions, the pile fabric of the present invention has good body so that it is close to the natural fur.

Since plural fibers are adhered as one unit, the surface of the pile fabric has resiliency. The pile fabric has both the resiliency and flexibility, particularly when only the tip portions of the guard hair-like fibers are adhered together or when the guard hair-like fibers are adhered over the part extending from their tips to the tips of the down fibers.

Since a plurality of the fibers are adhered together, each fiber does not tend to fall off or the fabric hardly suffers from crease.

The fur-like pile fabric of the present invention has a good covering property, that is, the base fabric of the pile fabric is well covered so that the base fabric is not seen. In addition, the guard hair-like fibers and the down hair-like fibers can be dyed with different colors.

Further, the appearance and/or feeling of the furlike pile fabric of the present invention can be modified through adjustment of the number of fibers constituting each unit. When the number of fibers is small, the pile fabric is rather soft, while when the number of fibers is large, the fabric is rather hard. Through the adjustment of difference of length between the guard hair-like fibers and the down hair-like fibers, the appearance and/or feeling of the pile fabric can be modified.

PREFERRED EMBODIMENTS OF THE INVENTION

The present invention will be illustrated by the following Examples, in which "%" is by weight.

The materials to be used in the Examples are listed in Table 1.

TABLE 1

| Material | Kind | Trade name | Configuration or properties to be specified |
|---|---|---|---|
| Fiber | Acrylic | Kanecaron LAR*1 | Flat cross section, Foamed, full dull |
| | | Kanecaron RCL*1 | Flat cross section, full dull |
| | | Kanecaron RFM*1 | Flat cross section, semidull |
| | | Kanecaron KCD*1 | Dope dyed fiber, semidull |
| | | Kanecaron SL*1 | Full dull |
| | | Kanecaron AHD(HS)*1 | Dope dyed fiber, slimy, shrinking factor of 32% (100° C., water), semidull |
| | Acrylic | Type 1*2 | Flat cross section full dull |
| | | Type 2*2 | Full dull |
| | Polyester*3 | | |
| Adhesive | Acrylate | Marposole M-1K*3 | Acrylate emulsion |

Note:
*1Acrylic fibers manufacture by Kanegafuchi Chemical comprising a copolymer of 48.5% of acrylonitrile, 50.5% of vinyl chloride and 1.0% of sodium styrenesulfonate.
*2Acrylic fibers manufacture by Mitsubishi Rayon, comprising a copolymer containing 91% of acrylonitrile.
*3Manufactured by Teijin.
*4Manufactured by Matsumoto Fat and Oil Co., Ltd.

The formed brush shaped fiber units are evaluated as follows:

Number of brush shaped fiber units per square inch

At an arbitrary position of the surface of the pile fabric, a thick pattern paper having a window of 1 $cm^2$ is placed, and the number of brush shaped fiber units in the window is counted. The counting is carried out at three different positions across the width of the fabric. Then, the counted numbers are averaged and multiplied by 6.45.

Brush shape

The shape of formed brush shaped fiber unit is visually observed and compared with the shapes of FIGS. 2, 4, 6, and 8. The similar shape is recorded by making reference to the figure number.

EXAMPLE 1

Raw fibers were formulated to include 15% of Kanecaron LAR (staple fiber of 20 deniers, 51 mm is fiber length and gold hue) and 85% of Kanecaron AHD (HS) (staple fiber of 4 deniers, 32 mm is fiber length and dark brown hue) and homogeneously mixed followed by opening and carding. Then, the fibers were knitted with a sliver knitting machine. After adjusting the clipped fiber length to 15 mm with pre-shearing, the fabric was passed through a dry hot air type pin tentering machine kept at 125° C. at a residence time of 5 minutes to complete the back coating with the acrylic resin and shrinking of the heat shrinkable fibers. The heat shrunk fibers composed the down hair-like fibers. Then, after subjecting the fabric to polishing and shearing, the fabric was finished to form a raised pile of 17 mm in clipped fiber length, which was used as a raw fabric. The length of the guard hair-like fiber was 17 mm, the length of the down hair-like fiber was 11.5 mm, the difference of length between the guard hair-like fiber and the down hair-like fiber was 5.5 mm, and the finished average weight of the fabric (METSUKE in Japanese) was 590 g/m$^2$.

Then, with using a rotary brush comprising pile hair loosening needles, the fibers were raised at an angle of about 70° to 80° from the plane of base fabric. With facing the raised fibers down, an aqueous adhesive solution containing 3% of Marposole M-1K was sprayed from a substantially vertical direction onto the pile surface of the raw fabric through a sector spray nozzle having a spraying angle of 115° and a foreign particle-passing diameter of 0.2 mm. The amount of adhesive to be applied was 25% based on the weight of raw fabric which corresponded to 0.75% of the pure adhesive. Then, with facing the raised fibers down, the fabric was beaten on its reverse face with a rotary beater, which was installed with its shaft in parallel with the width direction of the raw fabric and had a pair of flaps attached to the shaft at an angle of 180° with each other and each having a semicircular edge of 10 mm in radius at the outermost flap edge. By beating, the excessive adhesive was removed and plural fibers formed brush shaped units. The amount of remained adhesive was 14% which corresponded to 0.42% of pure adhesive.

Thereafter, with facing the raised fibers down, the fabric was passed through the pin tentering drying machine kept at 125° C. at a residence time of 5 minutes. Then, the appearance of the fabric was observed. The number of the brush shaped units was 185 units per square inch, and the shape corresponded to that of FIG. 2.

With the fabricated fur-like pile fabric, a stuffed toy of a brown bear was made. The toy had sharp fiber tips, natural lie of hair and ductility of the fiber tips, and it possessed the characteristics of the fabric of the present invention.

EXAMPLE 2

In the same manner as in Example 1 but formulating the raw fiber to include 30% of the type 1 acrylic fiber (staple fiber of 10 deniers, 51 mm in fiber length and light gray hue) and 70% of the type 2 acrylic fiber (staple fiber of 3 deniers, 28 mm in fiber length and charcoal gray hue), pre-shearing the fabric to clipped fiber length of 18 mm and shearing to clipped fiber length of 20 mm, a raw fabric was fabricated, which had the finished average weight of 640 g/m$^2$, a length of the guard hair-like fiber of 20 mm, a length of the down hair-like fiber of 17 mm and the difference of length between these two fibers of 3.0 mm.

Then, in the same manner as in Example 1, the adhesive was applied and removed. The amount of applied adhesive was 21% (corresponding to 0.63% of the pure adhesive) after spraying and 13% (corresponding to 0.39% of pure adhesive) after beating. The number of brush shaped fiber units was 212 units per square inch, and the shape corresponded to that of FIG. 4.

With the fabricated fur-like pile fabric, a stuffed toy rabbit was made. The toy had the same characteristics as that of Example 1 although the fiber tips were more stiff than those in Example 1.

EXAMPLE 3

In the same manner as in Example 1 but formulating the raw fiber to include 15 % of Kanecaron RFM (20 deniers, fiber length of 38 mm and black hue), 25% of Kanecaron KCD (7 deniers, fiber length of 51 mm and black hue) and 60% of Kanecaron AHD (HS) (4 deniers, fiber length of 32 mm and black hue), pre-shearing the fabric to clipped fiber length of 18 mm and shearing to clipped fiber length of 22 mm, a raw fabric was fabricated, which had the finished average weight of 700 g/m$^2$, a length of the guard hair-like fiber of 22 mm, the difference of length between the guard hair-like fiber and the middle hair of 3.0 mm and the difference of length between the guard hair-like fiber and the down hair-like fiber of 7.5 mm.

Then, in the same manner as in Example 1, the adhesive was applied and removed. The amount of applied adhesive was 31% (corresponding to 0.93% of the pure adhesive) after spraying and 18% (corresponding to 0.54% of pure adhesive) after beating. The number of brush shaped fiber units was 916 units per square inch, and the shape corresponded to that of FIG. 6.

Since the fabricated pile fabric contained the middle hair of Kanecaron RFM having the flat cross section, the middle portion of the pile looked thick and the guard hairs extended from the tops of the middle hairs so that the pile fabric was similar to the mink fur.

EXAMPLE 4

Raw fibers were formulated to include 60% of Kanecaron RFM (staple fiber of 20 deniers, 152 mm in fiber length and brown hue) and 40% of Kanecaron AHD (HS) (staple fiber of 4 deniers, 102 mm in fiber length and charcoal gray hue) and homogeneously mixed followed by card spinning to obtain carded single yarns of metric count of 14. The yarns were knitted in the form of boa raw fabric with a pile length (length of the pile yarn) of 10 mm and a drawn pile length (length of the drawn pile fiber) of 24 mm. After subjecting the raw fabric to pre-hair cracking (brushing) and back-coating and shrinking of the heat shrinkable fibers with a pin tentering dryer, the fabric was further subjected to hair cracking, polishing and shearing to obtain a raised hair raw fabric with clipping hair length of 13 mm. The finished average weight of the fabric was 530 g/m$^2$, the length of the guard hair-like fiber was 13 mm and the difference of length between the guard hair-like fiber and the down hair-like fiber was 5.0 mm.

Then, in the same manner as in Example 1, the adhesive was applied and removed. The amount of applied adhesive was 22% (corresponding to 0.66% of the pure adhesive) after spraying and 10% (corresponding to 0.30% of pure adhesive) after beating. The number of brush shaped fiber units was 194 units per square inch, and the shape corresponded to that of FIG. 2.

With the fabricated fur-like pile fabric, a stuffed toy sea-otter was made. Since the hair length was shorter than in Examples 1, 2 and 3, the lie of hair at the curved sewn portions was smooth and the toy had a natural appearance.

EXAMPLE 5

Raw fibers were formulated to include 30% of Kanecaron RCL (15 deniers, fiber length of 152 mm and white hue), 30% of Kanecaron SL (7 deniers, fiber length of 127 mm and white hue) and 40% of Kanecaron AHD (HS) (4 deniers, fiber length of 102 mm and brown hue) and homogeneously mixed followed by card spinning to obtain carded single yarns of metric count of 14. The yarns were dyed with a beige dye (cationic dye, 0.2%) with a spray type hank dyeing machine. Thereby, Kanecaron RCL and Kanecaron SL were dyed in beige hue, while Kanecaron AHD (HS) was dyed in brown hue. The yarns were knitted in the form of boa raw fabric and hair was raised in the same manner as in Example 4 except that a pile length (length of the pile yarn) was 11 mm, a drawn pile length (length of the drawn pile fiber) of 26 mm and a clipped fiber length of 13.5 mm to obtain a raw fabric having the finished average weight of 585 g/m$^2$, the length of guard hair-like fiber of 13.5 mm, the difference between the guard hair-like fiber and the middle hair of 1.5 mm and the difference of length between the guard hair-like fiber and the down hair-like fiber of 4.5 mm.

Thereafter, the fabric was tip printed with a roll type printing machine so that the tip portions of the pile of about 2 mm from the tip were dyed in dark brown (cationic dye, 3.0%) followed by steaming, washing, drying and post-finishing to obtain a raw fabric.

Then, in the same manner as in Example 1, the adhesive was applied and removed. The amount of applied adhesive was 26% (corresponding to 0.78% of the pure adhesive) after spraying and 12% (corresponding to 0.36% of pure adhesive) after beating. The number of brush shaped fiber units was 358 units per square inch, and the shape corresponded to that of FIG. 6.

With the fabricated fur-like pile fabric, a stuffed toy gorilla was made. The toy had coloring effects with high quality since the hue changed in three tones from the down hair, through the middle hair to the guard hair, and the hair tips were more darkly colored because of tip printing.

EXAMPLE 6

Raw fibers were formulated to include 30% of Kanecaron RCL (20 deniers, fiber length of 152 mm and white hue), 30% of Kanecaron SL (7 deniers, fiber length of 127 mm and white hue) and 40% of Polyester fiber (manufactured by Teijin) (4 deniers, fiber length of 89 mm and white hue) and homogeneously mixed followed by card spinning to obtain carded single yarns of metric count of 14. The yarns were dyed with a gray dye (cationic dye, 0.1%) with a spray type hank dyeing machine. The yarns were knitted in the form of boa raw fabric and hair was raised in the same manner as in Example 4 except that a pile length (length of the pile yarn) was 13 mm, a drawn pile length (length of the drawn pile fiber) of 30 mm and a clipped fiber length of 17 mm to obtain a raw fabric having the finished average weight of 720 g/m$^2$, the length of guard hair-like fiber of 17 mm, the length of the down hair-like fiber of 13.5 mm and the difference of length between the guard hair-like fiber and the down hair-like fiber of 3.5 mm.

Then, in the same manner as in Example 1, the adhesive was applied and removed. The amount of applied adhesive was 34% (corresponding to 1.02% of the pure adhesive) after spraying and 21% (corresponding to 0.63% of pure adhesive) after beating. The number of brush shaped fiber units was 85 units per square inch, and the shape corresponded to that of FIG. 4.

With the fabricated fur-like pile fabric, a stuffed toy chow-chow was made. The toy had the wild nature since the hair tips were stiff.

What is claimed is:

1. A fur-like pile fabric which comprises guard hair-like fibers and down hair-like fibers wherein a plurality of the fibers including the guard hair-like fibers constitute a unit and at least the guard hair-like fibers in the unit are adhered together in the form of a brush.

2. The fur-like pile fabric according to claim 1, wherein the difference of length between the guard hair-like fiber and the down hair-like fiber is at least 3 mm.

3. The fur-like pile fabric according to claim 2, wherein the difference of length between the guard hair-like fiber and the down hair-like fiber is from 4 mm to 10 mm.

4. The fur-like pile fabric according to claim 1, wherein the number of the brush form unit of the adhered fibers is at least 50 units per square inch.

5. The fur-like pile fabric according to claim 1, wherein the guard hair-like fibers and the upper portions of the down hair-like fibers are adhered and the lower portions of the down hair-like fibers are not adhered.

6. The fur-like pile fabric according to claim 1, wherein the guard hair-like fibers are foamed fibers.

7. A method for producing a fur-like pile fabric which comprises steps of forming a raw pile fabric comprising guard hair-like fibers having longer length and down-hair fiber having shorter length and adhering a plurality of the fibers including the guard hair-like fibers together.

* * * * *